US009328930B2

(12) United States Patent
Lin

(10) Patent No.: US 9,328,930 B2
(45) Date of Patent: May 3, 2016

(54) RANGE HOOD WITH AN EASILY ASSEMBLED AND DISASSEMBLED LAMP

(71) Applicant: LONG INDUSTRY INC., Taichung (TW)

(72) Inventor: Chun-Ying Lin, Taichung (TW)

(73) Assignee: LONG INDUSTRY INC., Taichung (TW)

( * ) Notice: Subject to any disclaimer, the term of this patent is extended or adjusted under 35 U.S.C. 154(b) by 50 days.

(21) Appl. No.: 14/179,971

(22) Filed: Feb. 13, 2014

(65) Prior Publication Data

US 2015/0184869 A1 Jul. 2, 2015

(30) Foreign Application Priority Data

Dec. 31, 2013 (TW) ..... 102225004 U

(51) Int. Cl.

| | |
|---|---|
| ***F24C 15/20*** | (2006.01) |
| ***F21V 21/04*** | (2006.01) |
| ***F21V 19/04*** | (2006.01) |
| ***F21V 17/14*** | (2006.01) |
| ***F21V 17/18*** | (2006.01) |
| ***F21S 8/02*** | (2006.01) |

(52) U.S. Cl.

CPC ..... *F24C 15/2064* (2013.01); *F21S 8/026* (2013.01); *F21S 8/028* (2013.01); *F21V 17/14* (2013.01); *F21V 17/18* (2013.01); *F21V 19/04* (2013.01); *F21V 21/043* (2013.01); *F21V 21/046* (2013.01)

(58) Field of Classification Search

CPC ..... F21V 17/18; F21V 21/30; F21V 19/04; F21V 19/042; F21S 8/028; F21S 8/026

USPC ..... 362/147, 148, 150

See application file for complete search history.

(56) References Cited

U.S. PATENT DOCUMENTS

| | | | | |
|---|---|---|---|---|
| 3,524,981 | A * | 8/1970 | Auerbach | F21V 17/14 362/433 |
| 4,763,231 | A * | 8/1988 | Houplain | 362/148 |
| 5,309,342 | A * | 5/1994 | Heinen, Sr. | F21S 8/02 362/147 |
| 5,465,199 | A * | 11/1995 | Bray | F21S 8/02 362/147 |
| 6,382,818 | B1 * | 5/2002 | Iwama | F21V 17/164 362/374 |
| 7,399,104 | B2 * | 7/2008 | Rappaport | F21S 8/02 362/147 |
| 8,376,592 | B2 * | 2/2013 | Engstrom | F21V 21/03 362/364 |
| 8,646,951 | B2 * | 2/2014 | Kim | H01R 33/94 362/148 |
| 8,702,274 | B2 * | 4/2014 | Breidenassel | F21V 17/12 362/249.01 |

(Continued)

*Primary Examiner* — Elmito Breval
*Assistant Examiner* — Zachary J Snyder
(74) *Attorney, Agent, or Firm* — WPAT, P.C., Intellectual Property Attorneys; Anthony King

(57) ABSTRACT

A range hood with an easily assembled and disassembled lamp includes a main body, a lamp seat, a lamp plug, a lamp, and a fastening device. Therein, the main body has a bottom board having an outer surface and an opposite inner surface with a combining hole in between. The lamp seat, with a lighting hole, rotationally moves between a first position and a second position for being longitudinally detached from the combining hole. The lamp plug is disposed on one side of the inner surface. The lamp has one end held by the lamp seat and the other end coupled to the lamp plug. The fastening device has one end connected to the lamp plug for attaching the lamp to the lamp seat. Thus, the lamp of the range hood is easily assembled or disassembled.

15 Claims, 10 Drawing Sheets

(56) References Cited

U.S. PATENT DOCUMENTS

| | | | | |
|---|---|---|---|---|
| 8,770,806 | B2 * | 7/2014 | Koo | F21V 13/02 362/246 |
| 2004/0027832 | A1 * | 2/2004 | Hyder | F21V 17/18 362/365 |
| 2012/0106176 | A1 * | 5/2012 | Lopez | F21K 9/00 362/382 |
| 2012/0162999 | A1 * | 6/2012 | Dupre | F21V 21/046 362/365 |
| 2013/0010476 | A1 * | 1/2013 | Pickard | F21S 8/026 362/311.03 |
| 2013/0201697 | A1 * | 8/2013 | Osada | F21S 8/02 362/373 |
| 2013/0235594 | A1 * | 9/2013 | Salomon | F21V 17/18 362/368 |

* cited by examiner

RANGE HOOD WITH AN EASILY ASSEMBLED AND DISASSEMBLED LAMP

BACKGROUND OF THE INVENTION

1. Field of the Invention

The present invention relates to range hoods, and more particularly, to a range hood with an easily assembled and disassembled lamp.

2. Description of the Related Art

Range hood is a kitchen apparatus for preventing people from inhaling too much cooking fume, which causes negative effects upon health, during the process of cooking.

An ideal range hood needs not only an appropriate appearance, size, power of suction, and cleansing efficacy, but also a sufficient lighting function. As a result, ordinary range hood is provided with a lamp embedded under the bottom face of the range hood, thereby offering a clear vision for people cooking.

However, such lamp is mostly embedded in an opening which is disposed on the bottom face, while the inner side of the opening is provided with a holder for coupling and fixing the lamp. When the bulb of the lamp malfunctions and needs to be renewed, due to the fact that the lamp holder is fixed, the user needs to reach the lamp from the lower side of the range hood and imposes a force for rotating and detaching the bulb. With such method, the rotating force is not imposed efficiently, causing inconvenience of operation. Furthermore, known lamp holders are provided in a manner of immovably fixed on the range hood, whereby the distance from the opening to the lamp holder remains unchangeable. As a result, the size of bulbs applicable to the opening is limited. Based on the fact that size of bulbs provided by different merchants varies, when the opening is provided with a comparatively short-length bulb, the lamp is unable to be installed tidily on the range hood, affecting the aesthetic appearance thereof.

SUMMARY OF THE INVENTION

For improving such difficulties, the present invention discloses a range hood with an easily assembled and disassembled lamp, wherein the lamp is rigidly attached on a lamp seat, while the lamp seat is moveably disposed on the bottom face of the range hood. Therefore, the lamp is easily assembled and disassembled.

The present invention provides a range hood with an easily assembled and disassembled lamp, comprising:

a main body provided with a bottom board, wherein the bottom board comprises an outer surface and an opposite inner surface with a combining hole disposed in between;

a lamp seat, provided with a lighting hole, coupled with the combining hole, and capable of rotationally moving between a first position and a second position, wherein the lamp seat is allowed to be longitudinally detached from the combining hole at the first position and is fixed on the peripheral edge of the combining hole at the second position;

a lamp plug, disposed on one side of the inner surface;

a lamp, with one end thereof held by the lamp seat and the other end thereof coupled to the lamp plug; and a fastening device, with one end thereof connected to the lamp plug and the other end thereof connected to the lamp seat or the bottom board for attaching the lamp to the lamp seat.

With such structure, when the lamp seat is at the first position, the lamp plug, the lamp, and the lamp seat are allowed to be removed downwardly together from the bottom board, whereby the user is able to maintain or renew the bulb.

After the maintenance, the lamp seat holding the lamp is coupled with the combining hole and rotationally moves from the first position to the second position to reach a steadily fixed status. Therefore, the present invention is easily assembled and disassembled, thereby offering the convenience of maintaining the lamp. Also, with the fastening device disposed between the lamp plug and the lamp seat or the bottom board, the distance between the lamp plug and the lamp seat or the bottom board is adjustable, whereby lamps of various sizes provided by different merchants are applicable to the present invention. As a result, lamps of various sizes are allowed to be tidily installed on the bottom board of the range hood.

Furthermore, with the fastening device between the lamp plug and the lamp seat, the lamp remains rigidly attached to the lamp seat, thereby reaching a steadily fixed status. In other words, no complex structures or components are needed for the present invention to position of the lamp. Therefore, the present invention possesses simple structures and components, thus lowering the cost of manufacturing.

For achieving the aforementioned objective, the fastening device of the present invention can be two resilient members, wherein each resilient member of the preferred embodiment is a spring.

DETAILED DESCRIPTION OF THE INVENTION

Other and further advantages and features of the present invention will be understood by reference to the description of the preferred embodiment in conjunction with the accompanying drawings where the components are illustrated based on a proportion for explanation but not subject to the actual component proportion.

Figure 1:
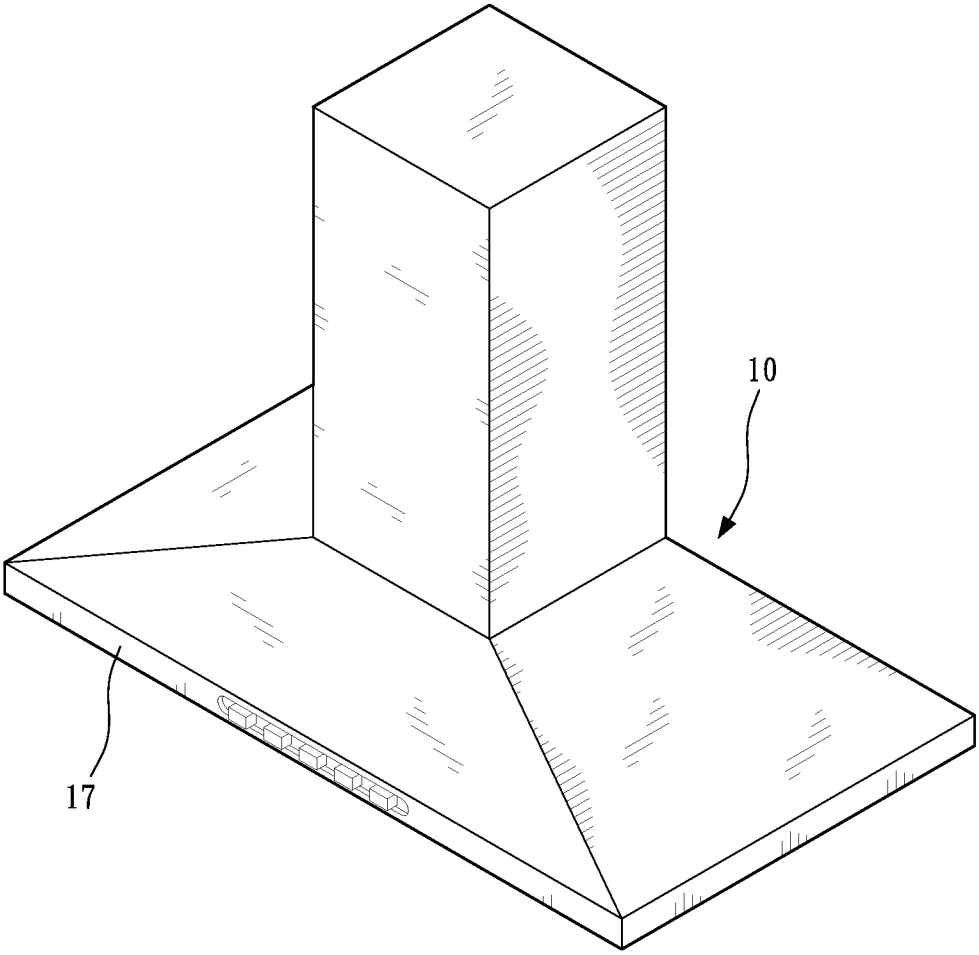
FIG. 1 is a perspective view of the range hood in accordance with the present invention.
Figure 2:
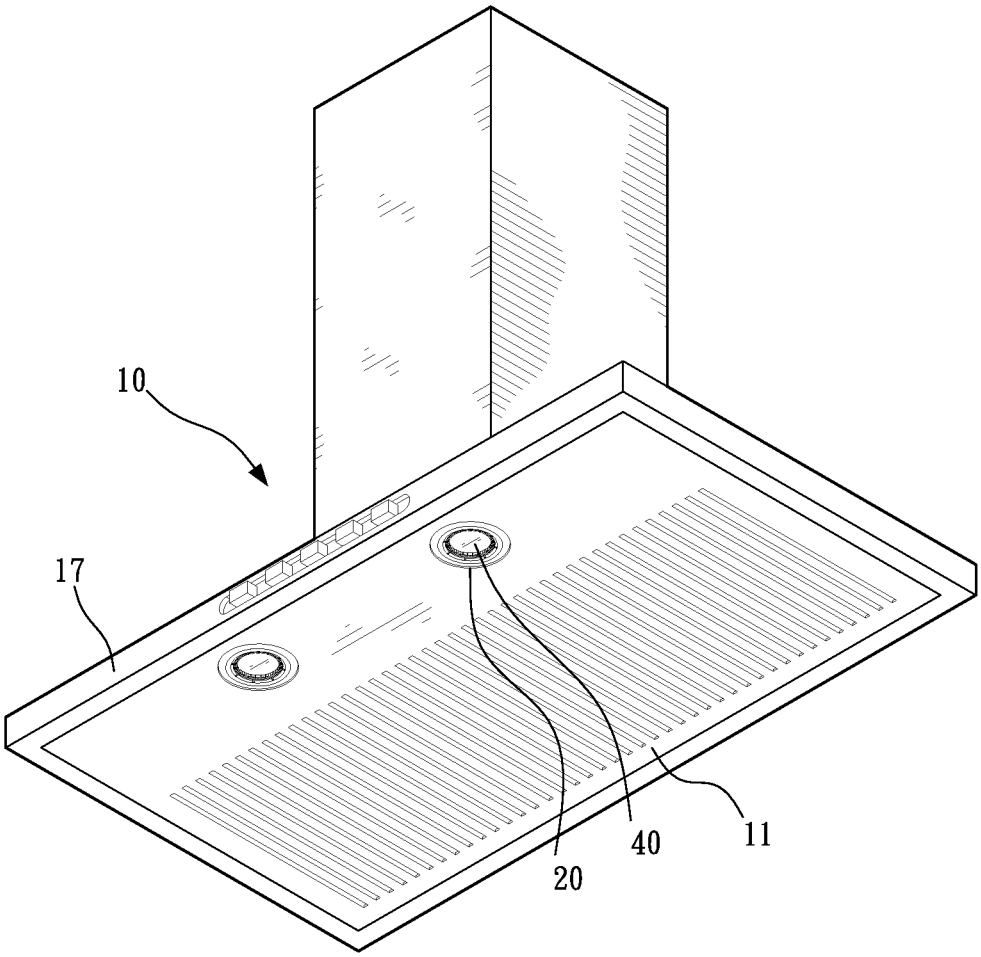
FIG. 2 is another perspective view of the range hood in accordance with the present invention.
Figure 3:
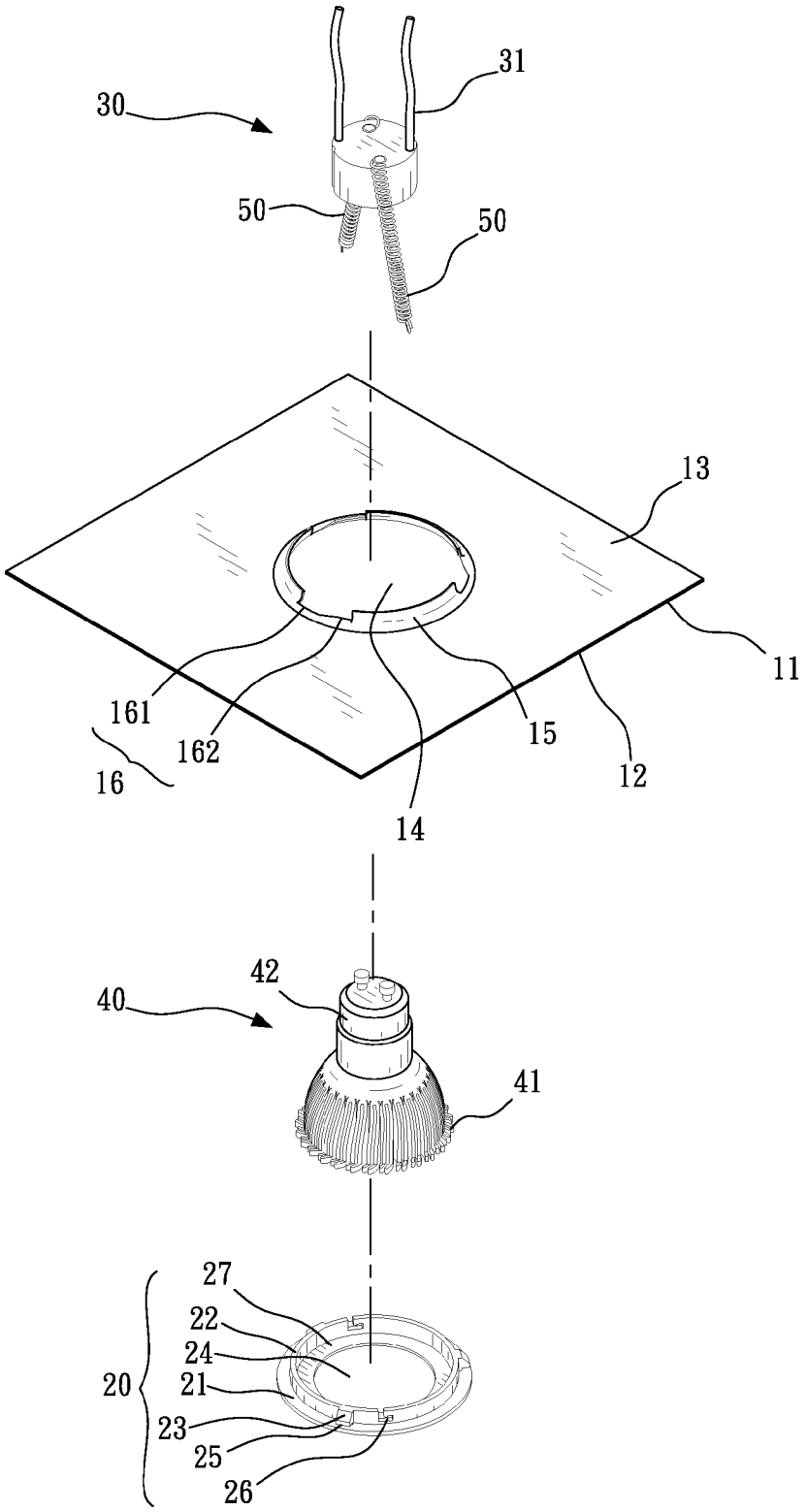
FIG. 3 is an exploded view of the range hood in accordance with the present invention.

Referring to FIG. 1 to FIG. 3, the range hood with an easily assembled and disassembled lamp provided by the present invention comprises a main body 10, a lamp seat 20, a lamp plug 30, a lamp 40, and a fastening device 50.

The main body 10 comprises a bottom board 11, which is provided with an outer surface 12 and an opposite inner surface 13 with a combining hole 14 disposed in between. The peripheral edge of the combining hole 14 is provided with a protrusive edge 15 protruding from the outer surface 12 toward the inner surface 13. The protrusive edge 15 is equidistantly provided with plural coupling parts 16, wherein three coupling parts 16 are provided in the preferred embodiment of the present invention. The coupling part 16 is present as a concave. Also, the front end of the main body 10 is provided with a control panel 17.

Figure 4:
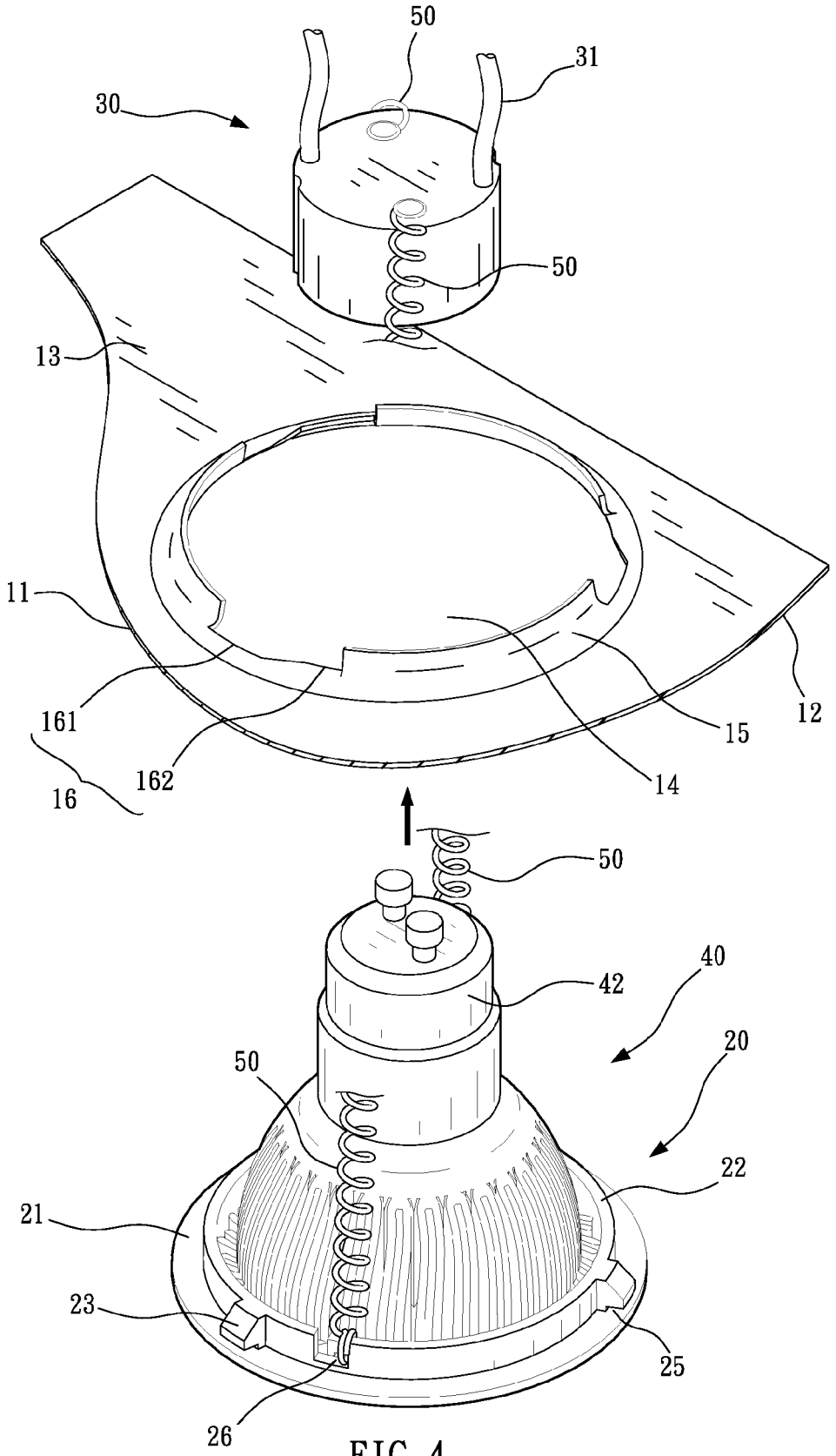
FIG. 4 is a schematic view illustrating the installation of the lamp seat on the range hood in accordance with the present invention.
Figure 5:
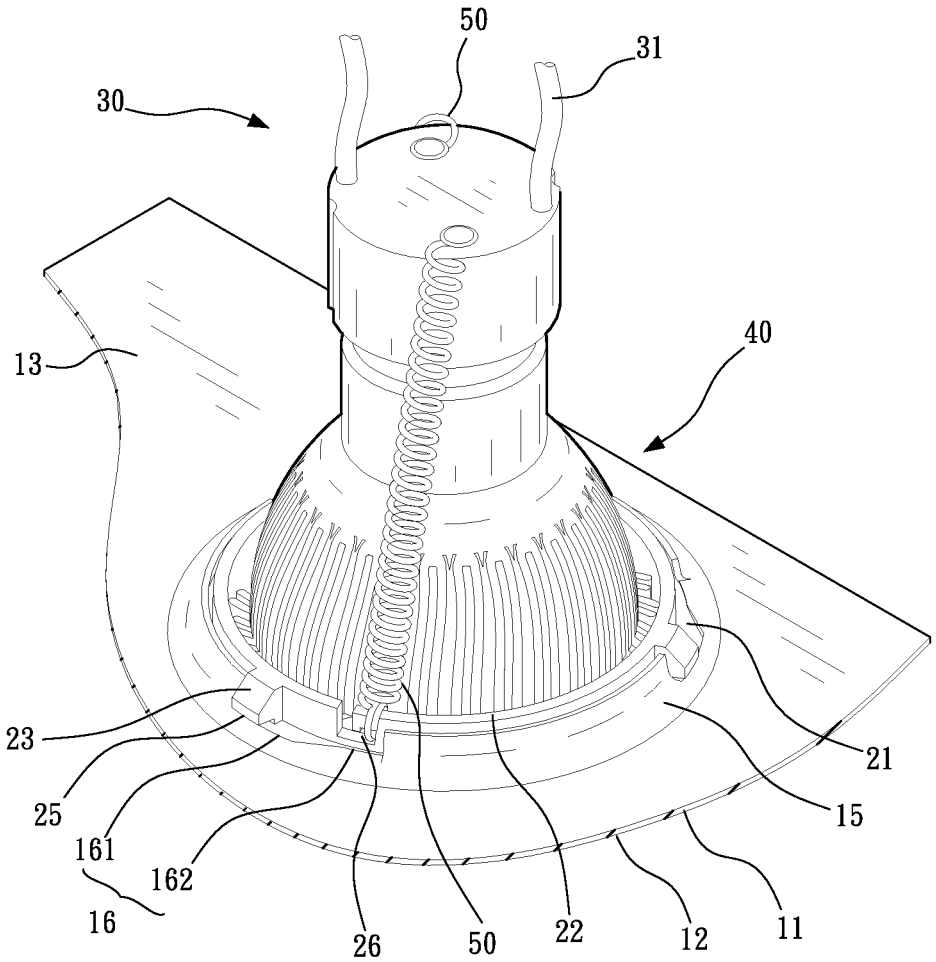
FIG. 5 is a schematic view illustrating the status of the lamp seat at the first position.
Figure 6:
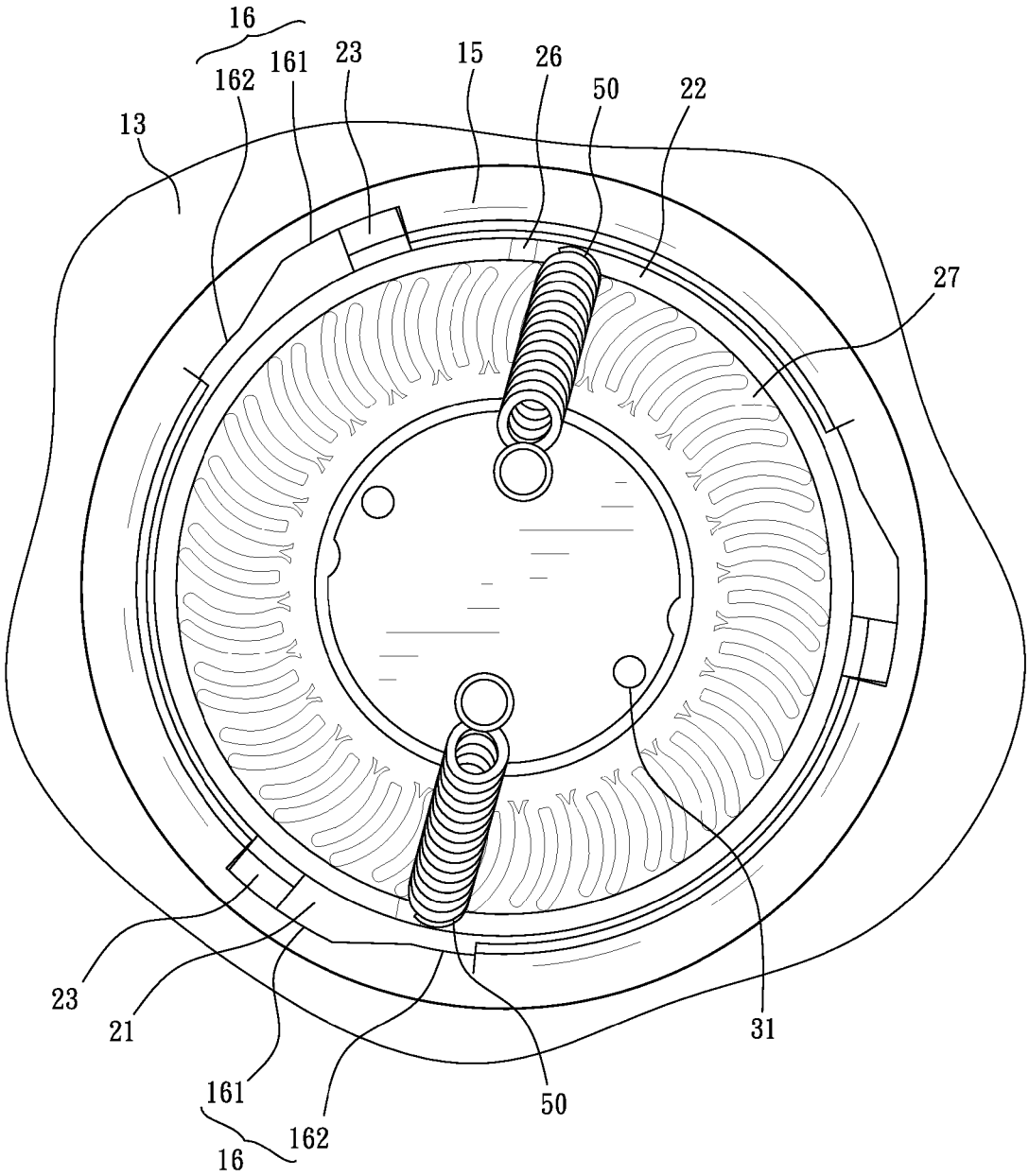
FIG. 6 is another schematic view illustrating the status of the lamp seat at the first position.

Also, the coupling part 16 is provided with a first edge 161 and a second edge 162, wherein the second edge 162 tapers from the first edge 161, while the distance from the first edge 161 to the center of the combining hole 14 is larger than the distance from the second edge 162 to the center of the combining hole 14 (as shown in FIG. 6). In addition, the vertical distance from the first edge 161 to the inner surface 13 is smaller than the vertical distance from the second edge 162 to the inner surface 13 (as shown in FIG. 4 and FIG. 5.

Figure 9:
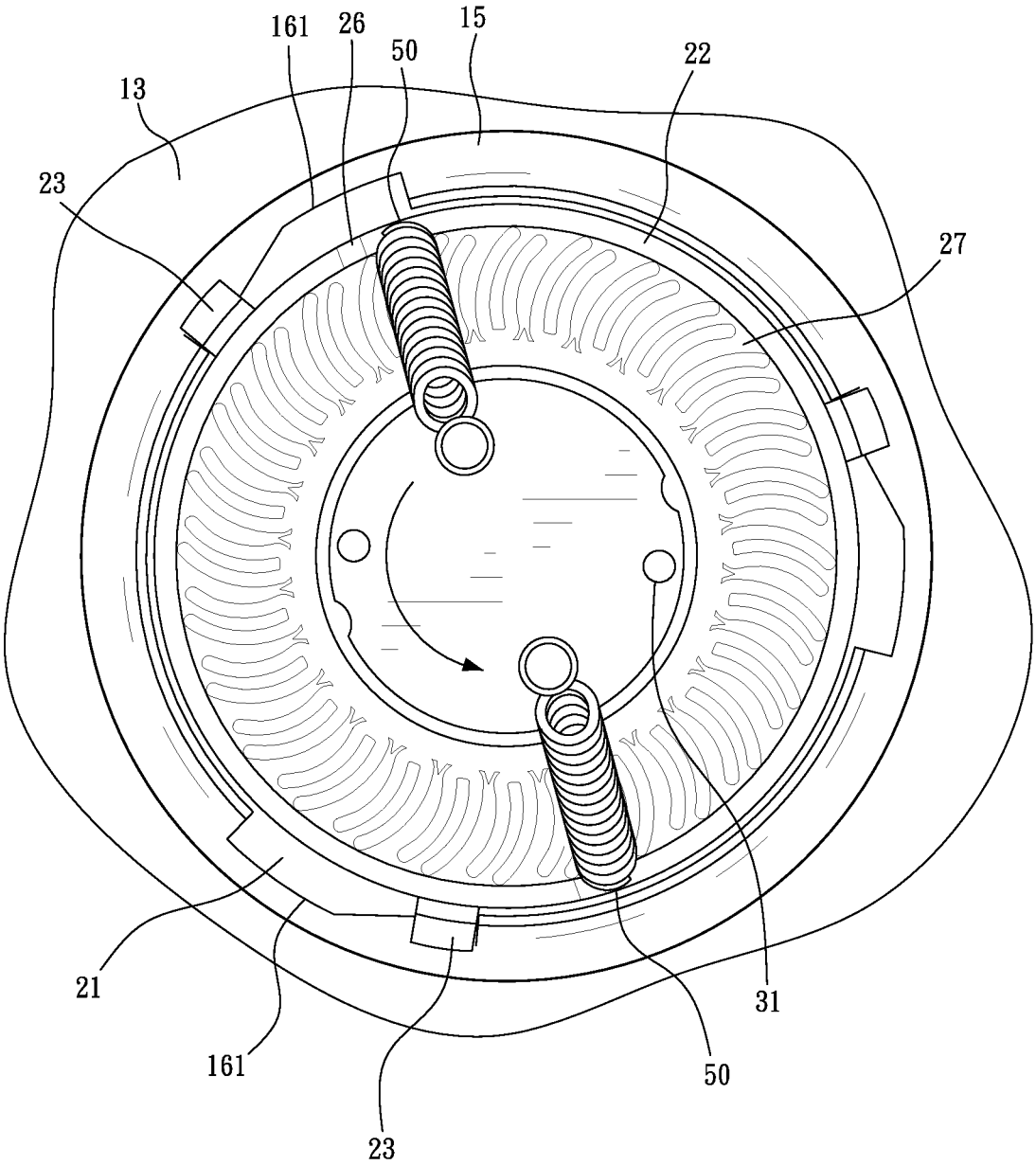
FIG. 9 is another schematic view illustrating the status of the lamp seat at the second position.

The lamp seat 20, disposed in the combining hole 14, is provided with a bottom part 21, while a ring part 22 is disposed on the bottom part 21. The outer peripheral edge of the ring part 22 is equidistantly provided with plural blocks 23 in correspondence with the coupling parts 16. A lighting hole 24 is disposed at the center of the inner peripheral edge of the ring part 22. In addition, a notch 25 is disposed between the bottom side of the block 23 and the bottom part 21. Therein, plural hooks 26, present as an L-shaped recess, are disposed on the ring part 22. Furthermore, the peripheral edge of the lighting hole 24 is provided with a ring-shaped holding edge 27. Also, the height of the ring part 22 is higher than the height of the protrusive edge 15. Furthermore, the distance from the first edge 161 to the center of the combining hole 14 is larger than or equal to the distance from the outer edge of the block 23 to the center of the lamp seat 20(as shown in FIG. 6). In addition, the distance from the second edge 162 to the center of the combining hole 14 is smaller than the distance from the outer edge of the block 23 to the center of the lamp seat 20 (as shown in FIG. 6 and FIG. 9).

The lamp seat 20 is removably coupled with the combining hole 14 and rotationally moves between a first position and a second position. When the lamp seat 20 is at the first position, the block 23 of the lamp seat 20 couples the first edge 161 of the corresponding coupling part 16, wherein the lamp seat 20 is able to longitudinally detaches from the combining hole 14. When the lamp seat 20 rotationally moves from the first position to the second position, the block 23 of the lamp seat 20 moves to and strides the second edge 162 of the coupling part 16, whereby the lamp seat 20 is coupled with the combining hole 14. As a result, the lamp seat 20 is prevented from longitudinally detaching from the combining hole 14.

The lamp plug 30 is provided with a wire 31 for connecting a controller (not shown) inside the main body 10, thereby being electrically connected to a power source.

The lamp 40, which is a LED luminary, comprises a lighting end 41 and a connecting end 42, wherein the connecting end 42 is rotatably coupled with the lamp plug 30 and the lighting end 41 is held by the holding edge 27 of the lamp seat 20. When the power is on, light beam projected by the lamp 40 penetrates through the lighting hole 24 and thus produces an illuminating effect.

The fastening device 50, in the preferred embodiment, comprises two resilient members, while each of the resilient members is a spring, with one end thereof connected to the lamp plug 30 and the other end thereof connected to the hook 26 of the lamp seat 20 for rigidly attaching the lighting end 41 of the lamp 40 to the holding edge 27 of the lamp seat 20, whereby the lamp 40 is allowed to be steadily combined inside the main body 10 without other additional components. In an alternate embodiment, the fastening device 50 is installed with one end thereof connected to the lamp plug 30 and the other end thereof connected to the bottom board 11, whereby the lamp 40 is as well rigidly attached to the lamp seat 20.

Referring to FIG. 4, when the user is installing the lamp 40, first, the lamp 40 is placed on the lamp seat 20. Next, the lamp 40 is plugged into the lamp plug 30, while the lamp 40 is allowed to be fittingly attached to the lamp seat 20 by use of the fastening device 50, whereby the lamp 40 is steadily held on the lamp seat 20. After the installation of the lamp 40, the lamp seat 20 holding the lamp 40 is combined in the combining hole 14, and the lamp seat 20 is placed at the first position, whereby the block 23 of the lamp seat 20 couples the first edge 161 of the coupling part 16. However, as shown in FIG. 5 and FIG. 6, the lamp seat 20 is not yet coupled with the second edge 162.

Figure 7:
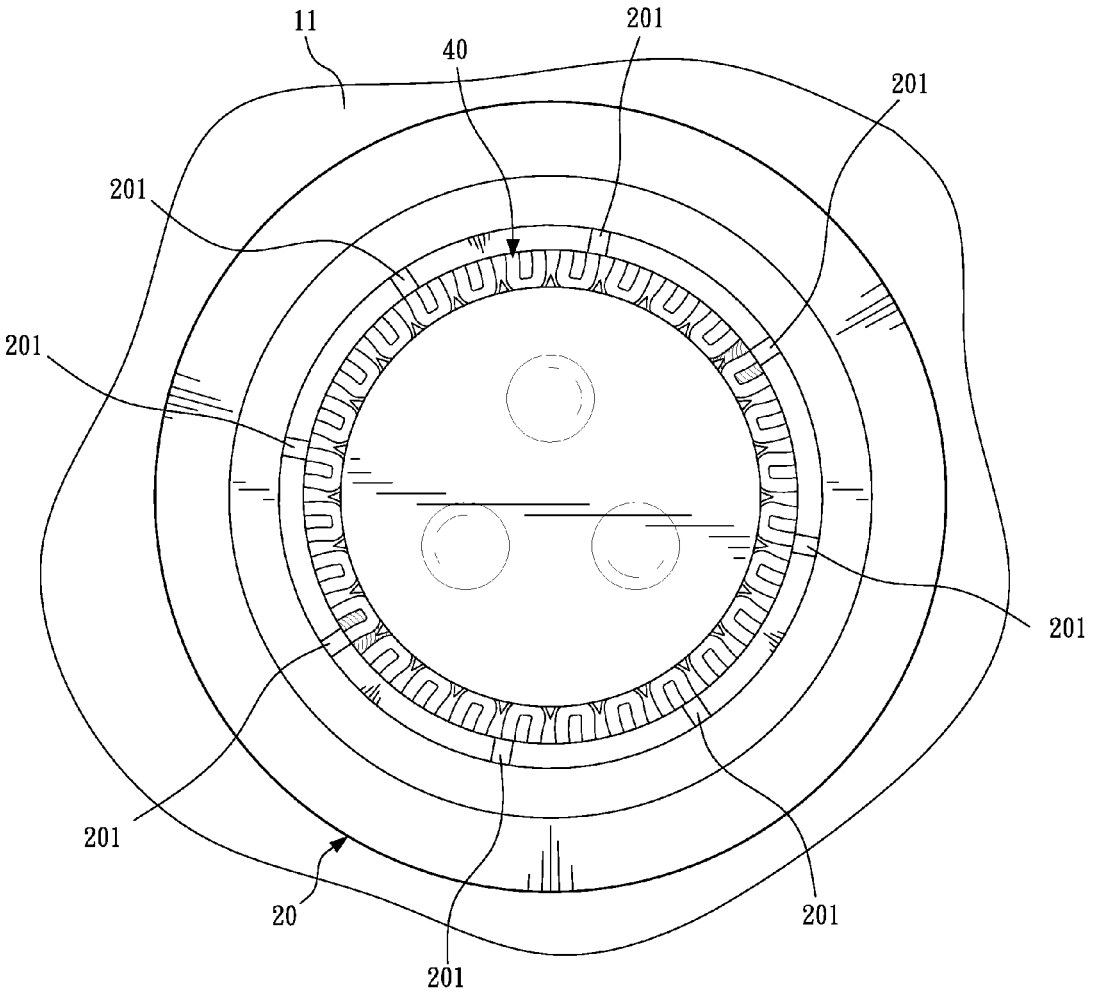
FIG. 7 is a partial bottom view of the range hood in accordance with the present invention.

Referring to FIG. 7, one side of the bottom part 21 opposite to the side provided with the block 23 is concavely provided with plural slots. When the lamp seat 20 is combined with the bottom board 11, the user is allowed to insert a tool in the slots 201 disposed on the lamp seat 20, thereby facilitating the lamp seat 20 rotation driven by tool against the bottom board 11 for coupling the lamp seat 20 with the bottom board 11.

Figure 8:
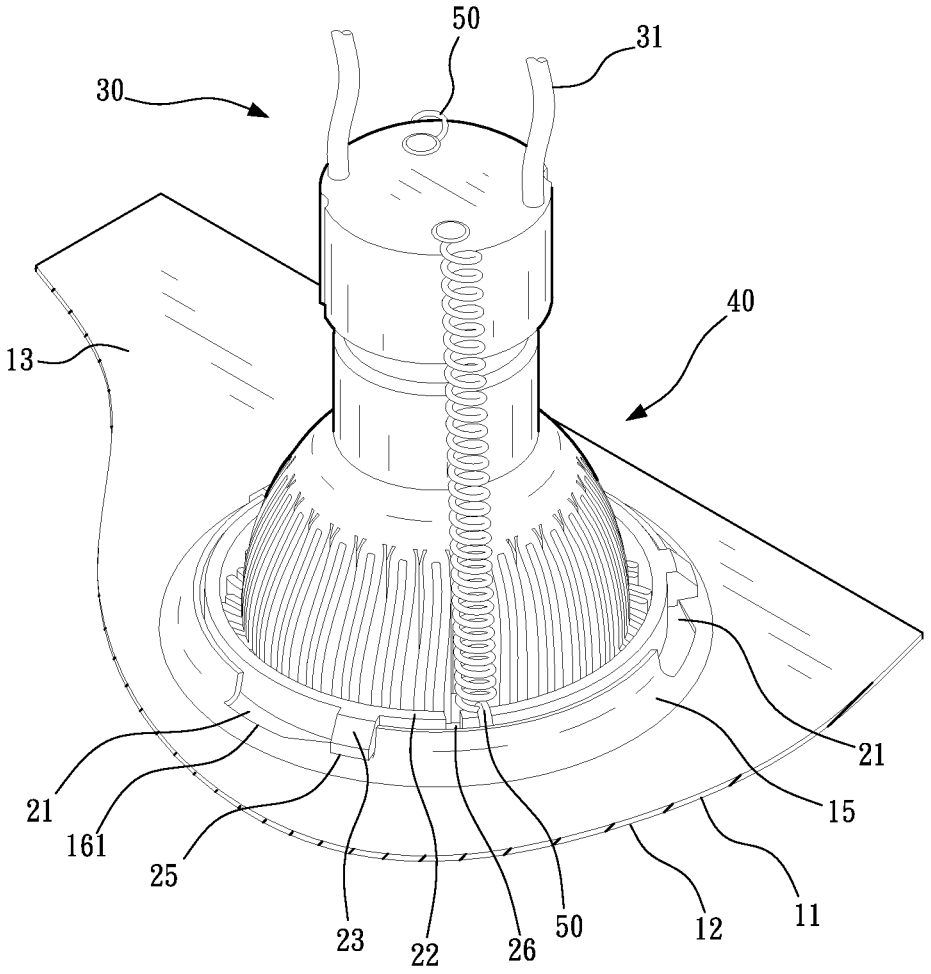
FIG. 8 is a schematic view illustrating the status of the lamp seat at the second position.

Referring to FIG. 8 and FIG. 9, when the user rotates the lamp seat 20 against the combining hole 14, the block 23 of the lamp seat 20 is moved from the first edge 161 to the second edge 162, and the block 23 thus moves to and strides the upper lateral of the second edge 162 of the coupling part 16, whereby the lamp seat 20 is coupled with the combining hole 14. As a result, the lamp seat 20 is prevented from longitudinally detaching from the combining hole 14, accomplishing a fixed status.

Likewise, when the user is renewing the lamp 40, the user needs only to rotate the lamp seat 20 with a tool, whereby the block 23 of the lamp seat 20 moves from the second edge 162 to the first edge 161. Because a predetermined length of the wire 31 is reserved, the lamp plug 30, the lamp 40, and the lamp seat 20 are allowed to be pulled downwardly together, whereby the user is able to pull the lamp seat 20 down from the bottom board 11 and afterward detach the lamp 40 from the lamp plug 30 for renewing the old lamp 40 with a new lamp 40. After the maintenance, the assembling method aforementioned is repeated to complete the installation of the lamp 40 and the lamp seat 20. Therefore, the present invention is offered with convenience for assembling and disassembling, whereby the renewing of the lamp 40 is facilitated. Also, the structure of the present invention is simple, while no complex components are needed, whereby the cost of manufacturing is lowered, and the competence of the present invention is thus offered.

Figure 10:
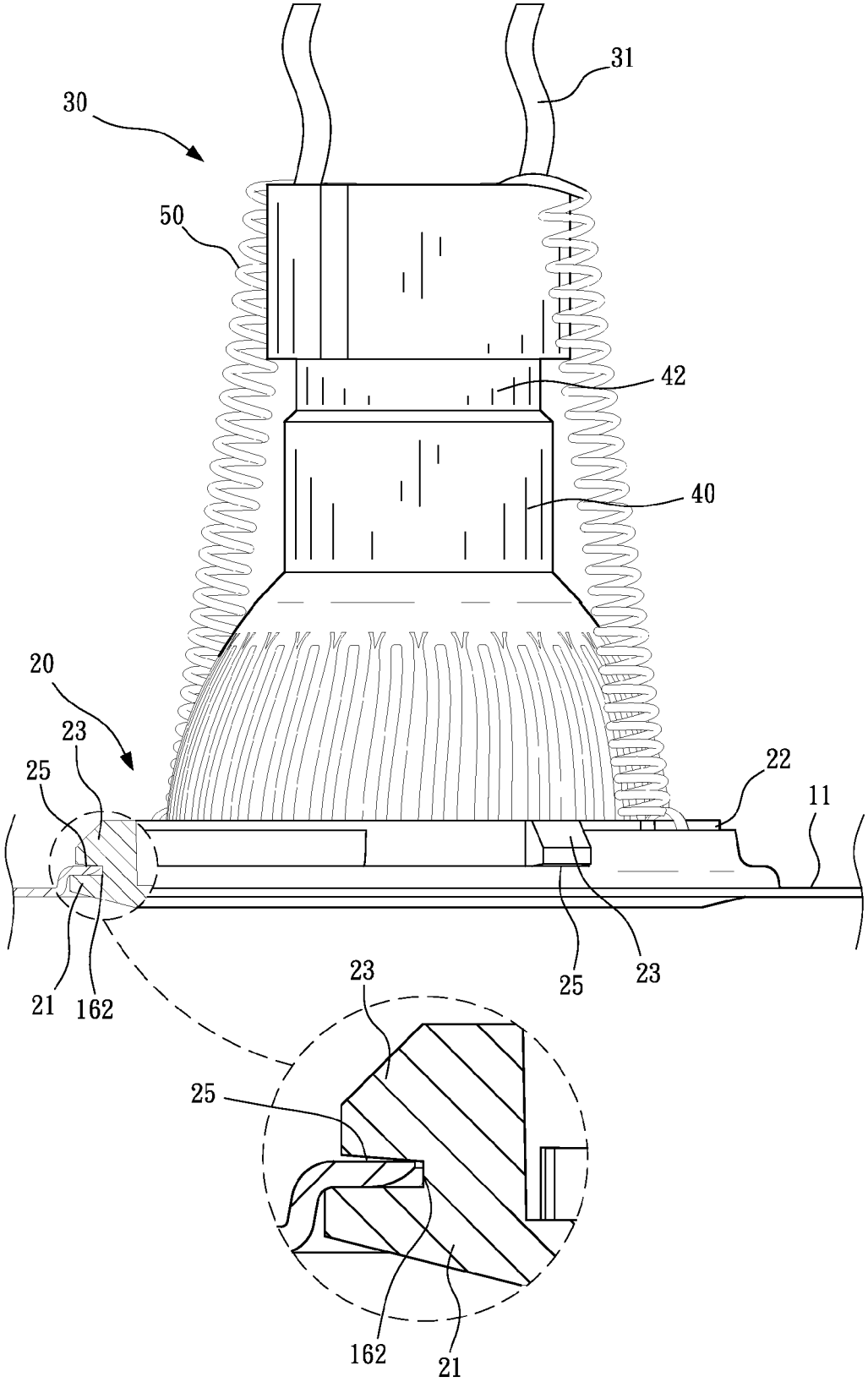
FIG. 10 is a partially enlarged schematic view illustrating the lamp seat installed on the bottom board of the range hood in the fixed status in accordance with the present invention.

Referring to FIG. 10, when the lamp seat 20 is at the second position, the block 23 moves to the upper lateral of the second edge 162, and the notch 25 thus receives the second edge 162, whereby the block 23 and the bottom part 21 are fixed on the upper lateral and the lower lateral of the second edge 162, respectively. As a result, a fixed status is reached to assure the coupling relationship of the lamp seat 20 and the bottom board 11.

To sum up, the range hood with an easily assembled and disassembled lamp of the present invention is provided with the fastening device, whereby the lamp is able to be rigidly attached to the lamp seat for achieving a steadily fixed status. Thus, the positioning effect of the lamp installation, the convenience of renewing the lamp, and the simpleness of the structure are provided simultaneously.

Furthermore, with the fastening device disposed between the lamp plug and the lamp seat or the bottom board, the distance between the lamp plug and the lamp seat or the bottom board is adjustable, whereby lamps with various sizes provided by different lamp merchants are applicable to be tidily installed on the bottom board of the range hood.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A range hood with an easily assembled and disassembled lamp, comprising:

a main body provided with a bottom board, wherein the bottom board comprises an outer surface and an opposite inner surface with a combining hole disposed in between, the peripheral edge of the combining hole having a protrusive edge protruding from the outer surface toward the inner surface, the protrusive edge equidistantly provided with plural coupling parts which are present as a concave; the concave shaped coupling part has a first edge and a second edge, wherein the distance from the first edge to the center of the combining hole is larger than the distance from the second ed e to the center of the combining hole such that a section between the first edge and the second edge tapers from the first edge to the second edge:

a lamp seat, provided with a lighting hole, coupled with the combining hole, and capable of rotationally moving between a first position at the first edge and a second position at the second edge, with plural blocks disposed around the lamp seat; when the lamp seat is at the first position, the lamp seat is allowed to be longitudinally detached from the combining hole; when the lamp seat is at the second position, the block strides the upper lateral of the second edge to be engaged with the corresponding coupling part;

a lamp, with one end thereof movably coupled with the lamp seat, the lamp disposed toward the lighting hole.

2. The range hood of claim 1, wherein one end of the lamp away from the lamp seat is provided with a lamp plug, and a fastening device is disposed between the lamp plug and the lamp seat, such whereby the lamp is tightly attached to the lamp seat.

3. The range hood of claim 1, wherein one end of the lamp away from the lamp seat is provided with a lamp plug, and a fastening device is disposed between the lamp plug and the bottom board, whereby the lamp is tightly attached to the lamp seat.

4. The range hood of claim, wherein the coupling parts and the corresponding blocks are both provided in an amount of three.

5. The range hood of claim 1, wherein the vertical distance from the first edge to the inner surface is smaller than the vertical distance from the second edge to the inner surface.

6. The range hood of claim 1, wherein the lamp seat is provided with a ring part, while the block is disposed on an outer peripheral edge of the ring part, and the lighting hole is disposed at the center of an inner peripheral edge of the ring part.

7. The range hood of claim 6, wherein the lamp seat is provided with a bottom part, while the ring part is disposed on the bottom part and a notch is disposed between the bottom side of the block and the bottom part.

8. The range hood of claim 2, wherein the fastening device comprises two resilient members.

9. The range hood of claim 8, wherein each of the resilient members is a spring.

10. The range hood of claim 9, wherein the lamp seat is provided with hooks corresponding to the resilient members for fixing the resilient members.

11. The range hood of claim 10, wherein the hook is present as an L-shape recess.

12. The range hood of claim 6, wherein the height of the ring part is higher than the height of the protrusive edge.

13. The range hood of claim 1, wherein the peripheral edge of the lighting hole is provided with a ring-shaped holding edge for holding the lamp.

14. The range hood of claim 7, wherein one side of the bottom part opposite to the side provided with the blocks is concavely provided with plural slots.

15. The range hood of claim 6, wherein the distance from the first edge to the center of the combining hole is not smaller than the distance from the outer edge of the block to the center of the lamp seat, and the distance from the second edge to the center of the combining hole is smaller than the distance from the outer edge of the block to the center of the lamp seat.

* * * * *